United States Patent [19]

Wallimann et al.

[11] Patent Number: 4,535,208

[45] Date of Patent: Aug. 13, 1985

[54] ACTUATING DEVICE FOR A HIGH-VOLTAGE SWITCH

[75] Inventors: Hubert Wallimann, Oberentfelden; Johann Blatter, Schönenwerd, both of Switzerland

[73] Assignee: Sprecher & Schuh AG, Aarau, Switzerland

[21] Appl. No.: 571,098

[22] Filed: Jan. 16, 1984

[30] Foreign Application Priority Data

Jan. 25, 1983 [CH] Switzerland ..... 410/83

[51] Int. Cl.[3] ..... H01H 35/38

[52] U.S. Cl. ..... 200/82 B; 200/148 F; 200/288

[58] Field of Search ..... 200/82 B, 34, 78, 288, 200/153 SC, 318, 148 R, 148 A, 148 B, 148 C, 148 D, 148 E, 148 F, 148 G, 148 H

[56] References Cited

U.S. PATENT DOCUMENTS 4,228,333 10/1980 Kii ..... 200/148 R

FOREIGN PATENT DOCUMENTS 1088133 9/1960 Fed. Rep. of Germany.
1540514 1/1970 Fed. Rep. of Germany.
1806951 1/1977 Fed. Rep. of Germany .
2417683 2/1978 France ..... 200/288
391058 4/1965 Switzerland .

*Primary Examiner*—A. D. Pellinen
*Assistant Examiner*—Morris Ginsburg
*Attorney, Agent, or Firm*—Werner W. Kleeman

[57] ABSTRACT

At least one actuating or cut-off spring is provided which is compressed in the cut-on or closed position of the switch and is coupled to an actuating linkage or rod leading to movable contacts of the switch. An arrangement is provided to variably modify the force exerted by the actuating spring on the actuating linkage in relation to the stroke. This arrangement consists of a force transmission device arranged between the actuating spring and the actuating linkage. The force transmission device permits taking into account the type of switching stroke to be executed and optimally adapting the force pattern during a switch cut-off stroke thereto. The variation of the force pattern during the switch closing or cut-on stroke is not symmetrical to that of the switch opening or cut-off stroke. The force transmission characteristics of the force transmission device are different according to the requirements of the switching stroke to be executed. The force transmission device is designed to suddenly reduce the force acting on the actuating linkage during a switch opening or cut-off stroke.

9 Claims, 12 Drawing Figures

OFF

P1

ON

ACTUATING DEVICE FOR A HIGH-VOLTAGE SWITCH

CROSS REFERENCE TO RELATED APPLICATION

This application is related to the commonly assigned copending U.S. application Ser. No. 06/449,670, filed Dec. 14, 1982, and entitled "Gas-Blast Switch", now abandoned.

BACKGROUND OF THE INVENTION

The present invention broadly relates to an actuating or drive device and, more specifically, pertains to a new and improved construction of an actuating or drive device for a high-voltage switch.

Generally speaking, the actuating or drive device of the present invention, which is used for high tension or voltage switches, is of the type comprising at least one actuating or cut-off spring which is cocked or tensioned in the switch cut-on or closed position. This actuating or cut-off spring is operatively coupled with a switching or actuating linkage or rod leading to a set of movable contacts of the switch. Means are provided in order to variably or non-uniformly modify, during a cut-off or opening stroke and as a function of the stroke, the force generated by the actuating or cut-off spring and effective upon the actuating linkage or rod.

In the case of high-tension or voltage switches the switch opening or cut-off stroke of the actuating device is one of the most important and critical motions. At the beginning of the switch opening or cut-off stroke the movable components, i.e. the movable switch contact points or set of movable contacts, must be rapidly accelerated from the stationary state. Then the switch cut-off stroke must be rapidly executed in order to obtain a rapid extinction of the switching arc. Finally, at the end of the switch opening or cut-off stroke, any small forces that may be still acting in the direction of the opening or cut-off stroke must be accommodated.

In order to accomplish this the German Pat. No. 1,806,951, granted Jan. 27, 1977, discloses using a series or tandem arrangement of two springs as the actuating or cut-off spring, the first of which has a steeper spring characteristic and a smaller displacement, perhaps limited by a stop, while the second spring has a flatter spring characteristic and a longer spring displacement. This results in a force-displacement diagram for the switch opening or cut-off stroke which at first falls steeply as long as the first spring is effective and then, following a discontinuity, runs considerably flatter, since only the second spring is effective. This force-displacement relationship may be suitable for the switch opening or cut-off stroke, but it is the reverse or mirror image for the switch closing or cut-on stroke. While at the beginning of the switch closing or cut-on stroke at first only the second, weaker spring must be compressed, suddenly the first, stiffer spring must also be compressed. That is, in the execution of a switch closing or cut-on stroke the switch cut-on drive is subjected to a shock which can lead to undesirable vibrations in the actuating or drive system.

In Swiss Pat. No. 391,058, granted Apr. 30, 1965, an actuating or drive device is described in which a single actuating or cut-off spring directly drives the actuating linkage or rod by means of a crank. A two-stage hydraulic device is arranged in parallel with the actuating or cut-off spring. It is employed as a damping device during the switch opening or cut-off stroke and as a hydraulic drive during the switch closing or cut-on stroke. In this case, the motion induced by the force of the actuating or cut-off spring at the beginning of the switch opening or cut-off stroke is damped relatively little and later more. At the beginning of the switch closing or cut-on stroke this prior art arrangement must first supply a maximum force which then diminishes towards the end of the switch closing or cut-on stroke. The maximum force is obtained by furnishing pressurized fluid from a pressure storage means or from a pump. In addition to this disadvantage, this construction entails considerable technical complications.

SUMMARY OF THE INVENTION

Therefore, with the foregoing in mind it is a primary object of the present invention to provide a new and improved construction of an actuating or drive device which does not have associated therewith the aforementioned drawbacks and shortcomings of the prior art constructions.

Yet a further significant object of the present invention aims at providing a new and improved construction of an actuating or drive device of the character described which is relatively simple in construction and design, extremely economical to manufacture, highly reliable in operation, not readily subject to breakdown or malfunction and requires a minimum of maintenance and servicing.

Now in order to implement these and still further objects of the invention which will become more readily apparent as the description proceeds, the actuating or drive device of the present invention is manifested by the features that the means for variably or non-uniformly modifying the force generated by the actuating or cut-off spring comprises a force transmission device or mechanism arranged between the actuating or cut-off spring and the actuating linkage or rod which is structured to have a force-displacement curve or characteristic which differs according to the type of switching stroke and which provides a sudden reduction of the force acting on the actuating linkage or rod during a switch opening or cut-off stroke.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 2 through 5 show simplified schematic partial sections through the force transmission device of the switch actuating or drive device according to FIG. 1, wherein FIG. 2 illustrates the force transmission device in the closed or cut-on position of the switch, and FIGS. 3 to 5 illustrate the same in the various phases of a switch opening or cut-off stroke;

DETAILED DESCRIPTION OF THE PREFERRED EMBODIMENTS

Figure 1:
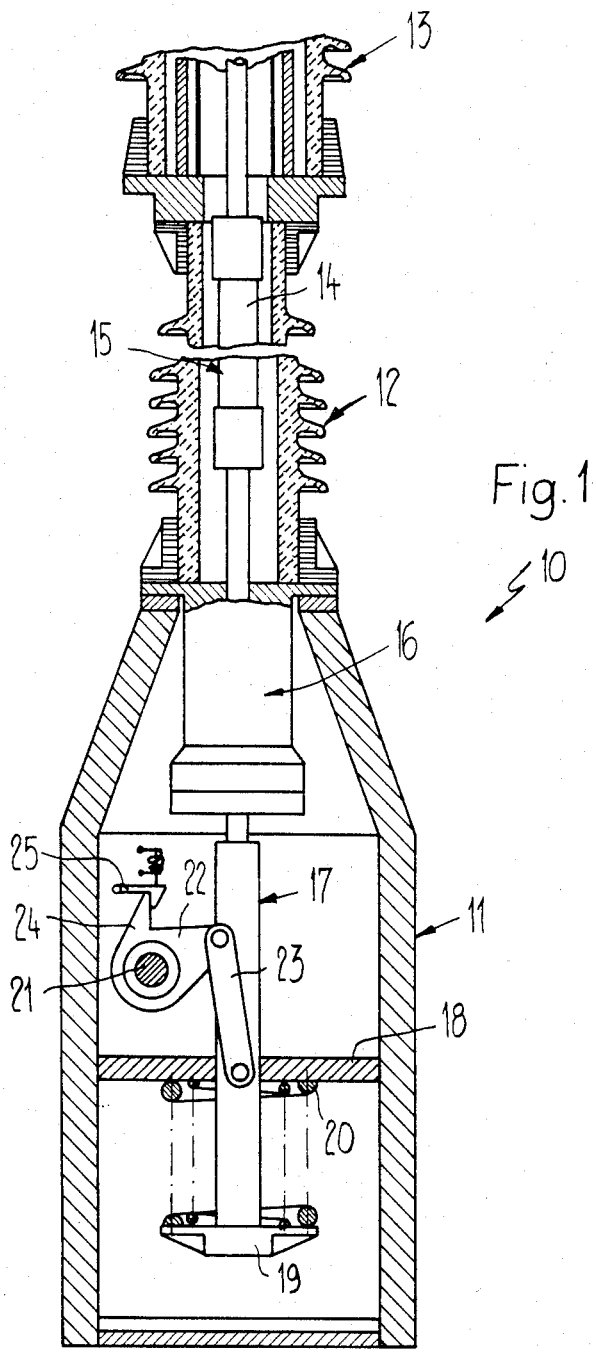
FIG. 1 is a schematic section through the drive housing of a high-voltage switch incorporating a first embodiment of the actuating or drive device of the invention.

FIG. 1 shows a high-tension or high-voltage switch 10 having a drive or transmission housing 11. A tubular support insulator 12 rests on the drive housing 11 and supports a further insulator 13 containing an appropriate switching chamber and switch contacts, not shown in the drawings. A reciprocatable actuator link or rod 15 comprising an insulating section 14 passes through the support insulator 12. The actuator or actuating rod 15 transmits linear motion from a force transmission device 16 to be described later to the switch chamber. A drive rod 17, defining a traction and thrust rod, leads from the force transmission device 16 through a suitable aperture in a partition wall or bulkhead 18 provided in the drive housing 11 to a spring seating member plate 19 mounted on its lower end. An actuating or cut-off spring 20 is compressed between the partition wall 18 and the spring seating member or plate 19. The actuating or cut-off spring 20 is shown here in the form of two coaxial telescoped compression springs.

A switch control or cut-on shaft 21 of a switch cut-on drive mechanism not shown in the drawings passes into the drive housing 11. A crank arm 22 is fixedly mounted on the switch control or cut-on shaft 21. The free end of the crank 22 pivotably engages one end of a connecting link 23 whose other end is pivotably connected to the drive rod 17. The hub of the crank 22 is provided with a ratchet tooth 24 which cooperates with a ratchet pawl 25 in the closed or cut-on position of the switch illustrated in FIG. 1. The ratchet pawl 25 can be electromagnetically disengaged. When the switch 10 is to be opened the pawl 25 is lifted. The actuating or cut-off spring 20 can then expand or relax and the switch control or cut-on shaft 21 is rotated clockwise.

The force transmission device 16 will now be described with reference to FIG. 6. This force transmission device 16 comprises an outer housing 26 mounted at the upper end of the drive housing 11 and extending downward within it. The lower end of this housing 26 is closed off by a flanged cap or cover 27 through which the drive rod 17 passes. A connecting flange or port 28 is provided at the upper end of the housing 26 for communication with a sight glass or a reservoir or both, not shown in the drawings. The outer housing 26 is filled to the level of the broken line 29 with a hydraulic fluid. A stepped or two-stage cylinder 30 is installed between the upper end of the outer housing 26 and the lower flanged cap or cover 27. The inner wall of the housing 26 and the outer wall of the stepped cylinder 30 enclose a jacket space 31 between them.

The upper part of the stepped cylinder 30 is formed by two telescoped cylinder sleeves or sleeve members 32, 33. The inner sleeve 32 is shorter than the outer sleeve 33. Immediately below the lower end of the inner cylinder sleeve 32, the outer cylinder sleeve 33 is bored out to a larger diameter. The lower end of the inner sleeve 32 forms jointly with the enlarged bore of the outer sleeve 33 a step 34 of the stepped cylinder 30. A third cylinder sleeve or sleeve member 35 is inserted into the outer cylinder sleeve 33 from below. The upper end of the third sleeve 35 butts against the step 34 and is provided with large radial apertures or passages 36. The axial dimension of apertures or passages 36 is less than the length of the bored out region of the outer cylinder sleeve 33. The lower end of the third sleeve 35 is anchored in the flanged cap or cover 27. In this same region, the third sleeve 35 is provided with two sets of radial apertures or orifices 37, 38. The upper set of apertures or orifices 37 has a greater flow capacity and the adjacent lower set of orifices or apertures 38 has a lesser flow capacity.

A braking or damping ring 39 is inserted in the lower end of the third sleeve 35 in contact with the flanged cap or cover 27. The braking ring 39 is provided with apertures or orifices 39′ which align with the apertures or orifices 38 of the lowest circumferential row. This completes the description of the stationary components of the force transmission device 16.

A hollow stepped or two-stage piston or dashpot 41 is mounted to the lower end of the actuating rod or linkage 15 by means of a bolt 40. The stepped piston or dashpot 41 comprises an upper piston head or dashpot base 43 having a through opening or aperture 44 and a cylinder or dashpot sleeve 45 surrounding the dashpot base 43 and fixed thereto. The outer diameter of the dashpot sleeve 45 slidingly engages the inner diameter of the inner cylinder sleeve 32. The dashpot sleeve 45 surrounds and is fixedly mounted to a ring flange or dashpot cover 46 at its lower end. The outer diameter of the dashpot cover 46 slidingly engages the inner diameter of the third cylinder sleeve 35. A spacer tube 47 is supported on the dashpot cover 46. At approximately the height of the upper end of the spacer tube 47, the cylinder or dashpot sleeve 45 is provided with radial apertures or orifices 48 having a relatively great flow capacity. This completes the description of the components moving jointly with the actuating rod 15.

The following components are fixedly mounted to the drive rod 17 by means of a bolt 49: a braking piston 50 whose outer diameter corresponds to the inner diameter of the braking ring 39 and, through a spacer tube 51, a further damping piston 52 whose outer diameter slidingly engages the inner diameter of the cylinder or dashpot sleeve 45.

The dashpot cover 46 and the spacer tube 47 slidably engage the outer diameter of the spacer tube 51. The damping piston 52 is provided with non-return or check valves 53. The check valves 53 unite the side of the piston 52 adjacent to the dashpot base 43 with the opposed side or face. When the piston 52 enters into contact with the dashpot base 43, the check valves 53 are forced open. Finally, a compression spring 54, having a relatively weak spring constant or characteristic, is supported between the damping piston 52 and the dashpot cover 46.

The jacket space or chamber 31 is connected by a passage 55 with the chamber 56 at the end of stepped cylinder 30 associated with the actuating rod 15.

Figure 2:
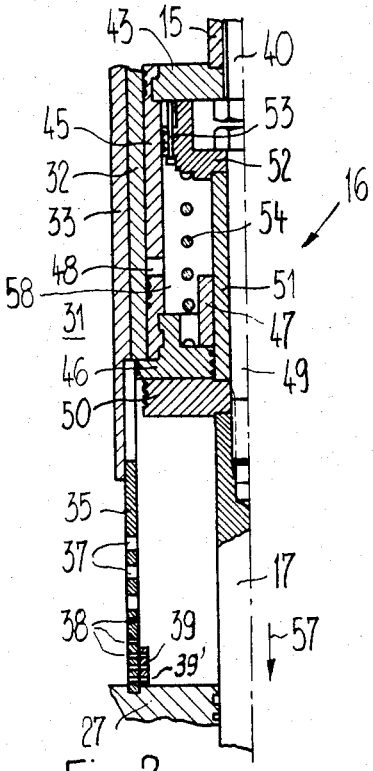

The function of the force transmission device 16 will now be described with reference to the FIGS. 2 through 6. It will be recalled that the actuating or cut-off spring 20 of this embodiment directly engages the spring seating member or plate 19 on the drive rod 17. FIG. 2 shows the force transmission device 16 in the closed or cut-on position of the switch 10. If the pawl 25 is raised or activated, the actuating or cut-off spring 20 immediately acts upon the drive rod 17 in the direction of the arrow 57 and thereby on the damping piston 52 and the braking piston 50. The aperture or apertures 48 in the dashpot sleeve 45 are still covered, i.e. closed off, by the inner cylinder sleeve 32. The hydraulic fluid in the space or chamber 58 between the damping piston 52 and the dashpot cover 46 can not be displaced from this space 48. On the other hand, hydraulic fluid flows out of the not particularly referenced chamber or space between the braking piston 50 and the flanged cap or cover 27 through the apertures or orifices 37 and through the jacket space 31 upwardly to opening 55 into the at first very small chamber or space 56 (see FIG. 6). The force exerted by the actuating or cut-off spring 20 generates a pressure in the dashpot chamber 58 corresponding to the area of the face of the damping piston 52 facing the dashpot cover 46. Since the area of the dashpot cover 46 (including the end surface of the spacer tube 47) is identical, the same force that is exerted by the actuating or cut-off spring 20 on the drive rod 17 acts on the stepped piston or dashpot 41 and therefore on the actuating rod 15. The actuating rod 15 therefore moves in the same direction and at the same speed as the drive rod 17. The force acting on the drive rod 17 linearly decreasingly varies in accordance with the spring constant curve characteristic of the actuating spring 20 and the amount of the stroke which has already been completed.

Figure 3:
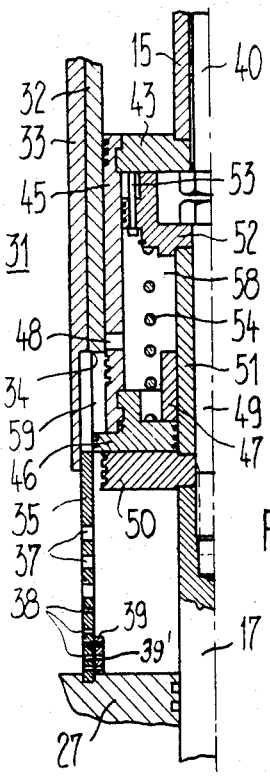

This state of motion continues until the position shown in FIG. 3 is reached. In this position the aperture 48 is about to be uncovered by the inner cylinder sleeve 32 and the dashpot cover 46 is about to enter into the third cylinder sleeve 35. As soon as it is uncovered, the aperture 48 provides flow communication between the chamber 58 and the annular space 59 axially defined by the step 34 at the top and by the upper edge of the third cylinder sleeve 35 and the radially protruding edge of the dashpot cover or ring flange 46 and radially defined by the outer surface of the dashpot sleeve 45 and by the exposed inner surface of the cylinder sleeve 33. This space or chamber 59 is a closed space and is filled with hydraulic fluid. Since the hydraulic fluid is practically incompressible, the pressure prevailing in the dashpot chamber 58 also prevails in the space 59. This pressure now acts on a greater surface since it now also acts on the edge of the dashpot cover 46 radially protruding beyond the dashpot sleeve 45. This has the result that a greater force suddenly acts upon the actuating rod 15. Because the dashpot cover 46 which is fixed to the drive rod 15 is still in intimate contact with the braking piston 50 which is fixed to the drive rod 17, this suddenly greater force does not immediately have an effect on the motion. Furthermore, the quantity of hydraulic fluid trapped in the spaces or chambers 58 and 59 is constant. As the dashpot cover 46 moves downward the volume of the space or chamber 59 increases which forcibly entails a decrease in the volume of the space or chamber 58.

Figure 4:
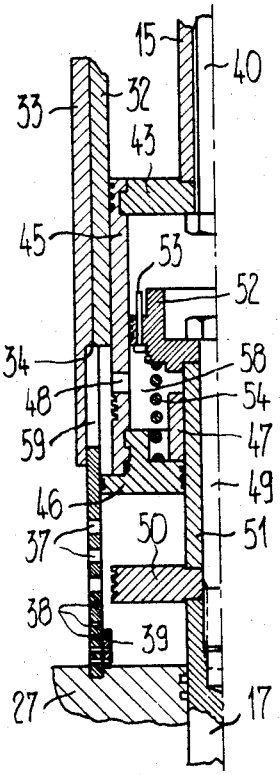
Figure 5:
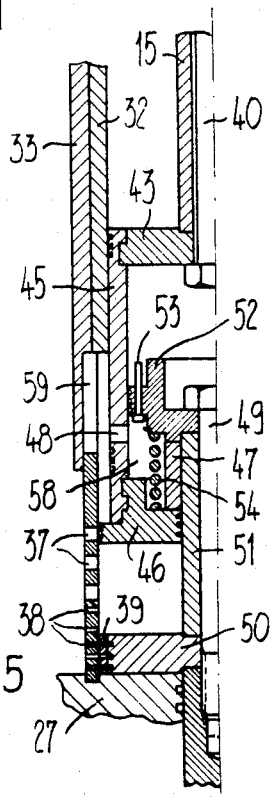

As can be seen in FIG. 4, the dashpot cover or ring flange 46 does not remain in contact with the braking piston 50, since the height of the dashpot chamber 58 necessarily decreases. The compression spring 54 is compressed. On the face of the damping piston opposite the damping chamber 58, hydraulic fluid flows through the aperture 44 (see FIG. 6) in the dashpot base or end flange 43.

Shortly after the position illustrated in FIG. 4 the braking piston 50 enters into the braking ring or ring member 39. The hydraulic fluid trapped between the flange cover 27 and the braking piston 50 can only escape through the orifices 39' in the braking ring 39 and the apertures 38 into the jacket space 31. This damps or brakes the motion of the drive rod 17 and brings it to a stop as soon as the braking piston 50 has reached the position shown in FIG. 5.

The influence of the actuating or cut-off spring 20 on the pressure prevailing in the spaces or chambers 58 and 59 ceases and with it the force acting on the actuator or actuating rod 15. On the other hand, the compression spring 54 is now completely compressed and has the tendency to push the dashpot cover 46 downward away from the damping piston 52. Since the spaces 58 and 59 are still jointly closed, hydraulic fluid must now be supplied to the space 58. The check valves 53 open to permit fluid to flow in. Now the dashpot cover 46 and with it the actuating rod 15 are acted upon only by the compression spring 54, at first according to the rate of flow of hydraulic fluid into the space 58 through the check valves 53. As soon as the dashpot cover 46 has travelled over the uppermost apertures 37, hydraulic fluid can also return into the space 59 and thereby also into the space 58 through these apertures. The hydraulic fluid contained between the dashpot cover 46 and the braking piston 50 can escape through the remaining apertures 37 into the jacket space or chamber 31.

Figure 6:
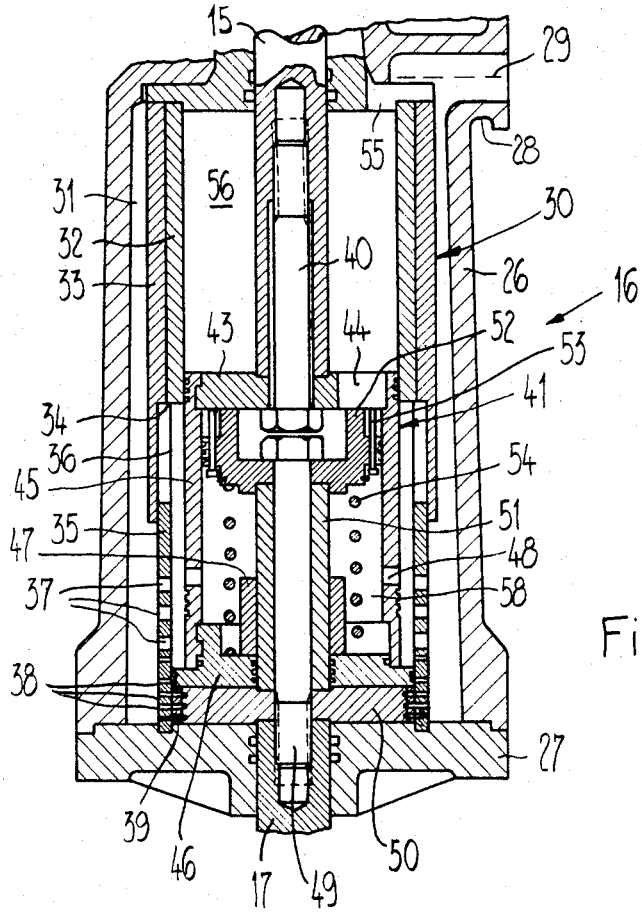
FIG. 6 is a schematic section through the force transmission device of the switch according to FIG. 1 in the open switch or switch cut-off position.

At the end of the stroke, i.e., when the dashpot cover 46 has travelled over the lowermost apertures 37, the downward motion of the dashpot cover 46 is damped or braked as is the downward motion of the braking piston 50 fixed to the drive rod 17 until the position shown in FIG. 6, i.e., the open or cut-off position of the switch, is reached.

It is to be noted that in the open or cut-off position of the switch (see FIG. 6), the components mounted on the drive rod 17 are in exactly the same relation to the components mounted on the actuator or actuating rod 15 as in the closed or cut-on switch position shown in FIG. 2.

Since the switch closing or cut-on drive mechanism also acts on the drive rod 17 (see FIG. 1) and the dashpot cover 46 rests on the braking piston 50 in the open or cut-off switch position, the aforementioned positional relationship is maintained until the position shown in FIG. 2 is reached once again.

Figure 7:
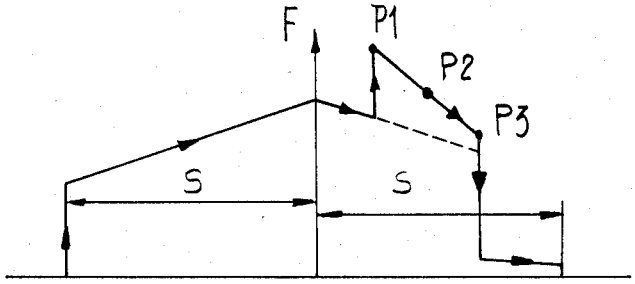
FIG. 7 is a force-displacement diagram of the switch actuating or drive device according to FIG. 1, wherein the part of the diagram to the right of the ordinate is for the switch opening or cut-off stroke and the part to the left is for the switch closing or cut-on stroke.

The force-displacement diagram shown in FIG. 7 for the force transmission device 16 and the actuating rod 15 derives from the action described above. The displacement or stroke of switch closing and switch opening motions is the same and is designated as s in FIG. 7. Consider first the curve illustrating the variation in force during a switch opening or cut-off stroke represented on the right-hand side of the ordinate axis F. Starting in the position shown in FIG. 2 and proceeding to the position shown in FIG. 3, the force transmitted to the actuating rod 15 corresponds to the force that the actuating or cut-off spring 20 exerts on the drive rod 17. The force transmission ratio is 1:1. Shortly after the position shown in FIG. 3, the force acting on the actuating rod 15 is subject to a sudden increase ( point P1). From this point on, the force diminishes according to a steeper characteristic curve. The point P2 represents the force acting on the actuating rod 15 in approximately the position shown in FIG. 4. Immediately after the force transmission device has gone past the position shown in FIG. 5, i.e., at the end of the stroke of the actuating or cut-off spring 20 (point P3), only the compression spring 54 acts on the actuating rod 15 with a relatively low force. At the end of the curve, that is in the position according to FIG. 6, a low residual force remains which acts on the actuating rod 15 in the open or cut-off switch direction. This is an indication that even in the fully open or cut-off switch position (as well as in the closed or cut-on switch position) the spring 54 is not completely relaxed.

As was mentioned above, the components mounted on the drive rod 17 have the same positional relationship to the components mounted on the actuating rod 15 in the open or cut-off switch position (see FIG. 6) as they do in the closed or cut-on switch position. This is reflected in the switch closing portion of the force-displacement diagram to the left of the ordinate axis F in FIG. 7. The actuating spring 20 is still compressed at the beginning of the switch closing or cut-on stroke, i.e., a relatively large force must be supplied at the very beginning of the switch closing stroke and it increases linearly until the end of the switch closing or cut-on stroke.

The embodiment of the invention shown in FIGS. 8 through 11 is somewhat simpler in construction. An essential difference from the embodiment shown in FIGS. 1 through 7 is that the switching drive mechanism comprising the switch control shaft 21, the crank 22 and the link 23 acts directly on the lower end of a tube or tubular member 60 which constitutes the lower end of the actuating rod 15. A force transmission device 16' is suspended on this lower end of the actuating rod 15. The details and structure of this force transmission device 16' are analogous to those of the force transmission device 16 of FIG. 6 and will become clear in the following description of its constituent components in relation to FIGS. 9, 10 and 11. The link 23 passes through a suitable slit in the partition wall or bulkhead 18 laterally adjacent to the tube 60. This slit is adapted to accommodate the rising and falling motion as well as the slight pivoting motion of the link 23.

Figure 8:
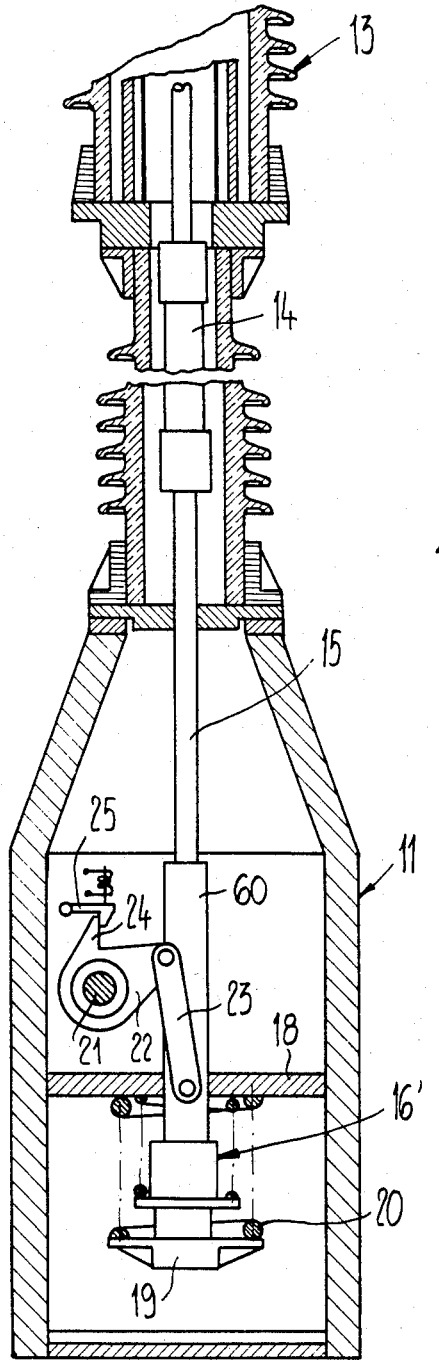
FIG. 8 is a schematic section through the drive housing of a switch incorporating a second embodiment of the force transmission device.
Figure 11:
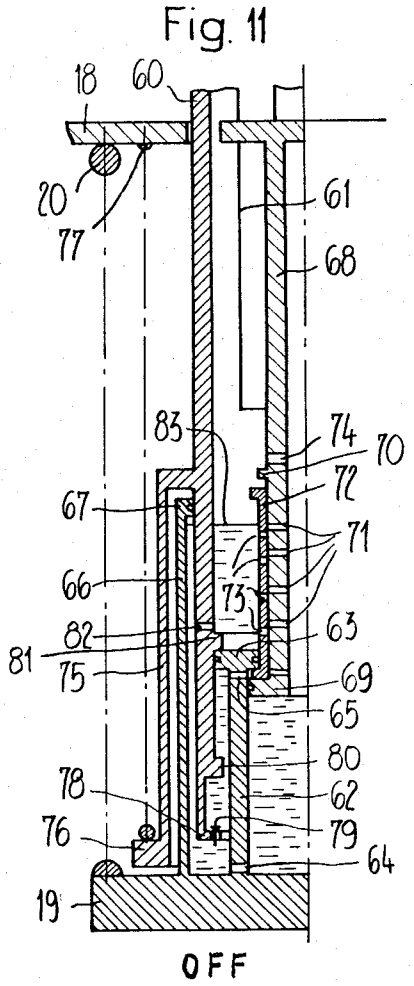
FIGS. 9 through 11 are partial sections through the force transmission device of the switch according to FIG. 8.
Figure 10:
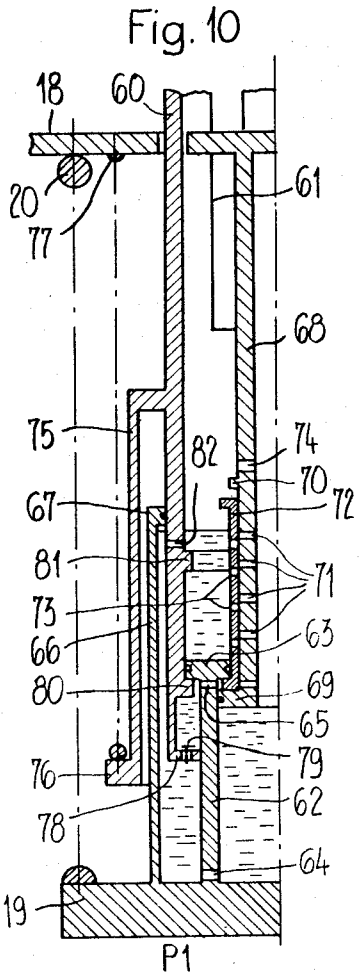
Figure 9:
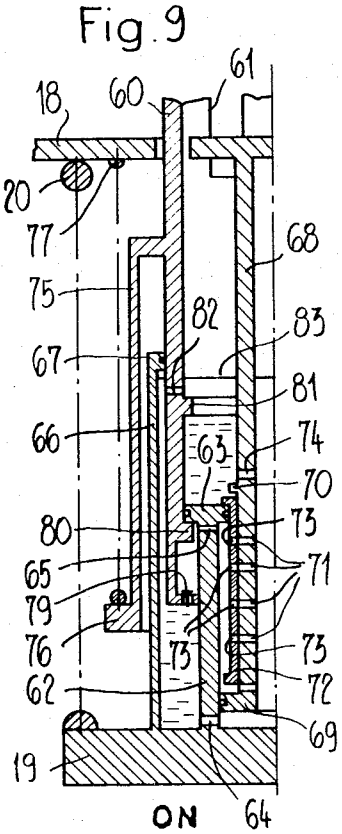

The tube 60 shown in FIG. 8 and in more detail in FIGS. 9, 10 and 11 is provided with axially oriented apertures or slits 61. It passes through the partition wall or bulkhead 18 in the region of these apertures 61. The upper end of the actuating or cut-off spring 20 is supported on the partition wall or bulkhead 18. The lower end of this actuating or cut-off spring 20 is supported on the spring seating member or plate 19. In this embodiment, the spring seating member or plate 19 is not mounted on a drive rod but carries an annular piston 63. The annular piston 63 is connected to the spring seating member or plate 19 by the upper end of a tubular column or support 62. The annular piston 63 extends beyond the tubular column or support 62 in the radial direction outwardly as well as inwardly. Orifices 64 and 65, respectively, are provided in the tubular column or support 62 in the immediate proximity of the spring seating member or plate 19 and of the annular piston 63.

A tubular sleeve 66 surrounding the tubular column or support 62 is mounted on the spring seating member or plate 19. An annular or ring flange or seal 67 is fastened to the upper end of the tubular sleeve 66 and extends inwardly therefrom. The ring flange or seal 67 sealingly engages the outer surface or diameter of the tubular member 60.

The side of the partition wall or bulkhead 18 facing the spring seating member or plate 19 carries a tubular core or element 68 extending downward therefrom. An annular flange 69 extending radially outward is formed on the lower end of the tubular core or element 68. The annular flange 69 sealingly engages the interior surface of the tubular column or support 62 in the region between the spring seating member or plate 19 and the annular piston or flange 63. The tubular core or element 68 is also provided with an external annular flange or stop collar 70. A number of orifices 71 are provided in the tubular core or element 68 between the annular flange 69 and the stop collar 70. The tubular core 68 is surrounded by a slidable sleeve 72 in the region between the stop collar 70 and the annular flange 69. The slidable sleeve 72 is provided with orifices or apertures 73 in the same number and same arrangement as the orifices or apertures 71. Each of the orifices 73 aligns with an orifice 71 when the sliding sleeve 72 has reached its upper limiting position, i.e., when it rests against the stop collar 70. On the other hand, the sliding sleeve 72 closes the orifices 71 when it rests against the annular flange 69. The tubular core or element 68 is provided with a further aperture or orifice 74 above the stop collar 70.

A cylindrical skirt 75 is fastened to the portion of the tube or tubular member 60 below the partition wall or bulkhead 18. The cylindrical skirt 75 is open at its lower end and surrounds the tubular member 66 with clearance. Its lower edge is provided with an annular or ring-shaped flange 76 extending outward. A compression spring 77 is restrained between this annular flange 76 and the partition wall or bulkhead 18. The spring constant of compression spring 77 is considerably lower than that of the actuating or cut-off spring 20.

The tube or tubular member 60 is provided with an annular or ring-shaped flange 78 at its lower end extending inward and sealingly engaging the outer surface of the tubular column or support 62. At least one non-return or check valve 79 opening in the direction of the annular piston 63 is built into the annular flange 78. Furthermore, two stop rings 80, 81 are formed on the interior of the tube or tubular member 60. The tubular member 60 is provided with one or more apertures or orifices 82 above the stop ring 81.

The tubular member 66 forms jointly with the spring seating member or plate 19 a sort of cup or dashpot which is filled with hydraulic fluid to the level indicated by the line 83.

The closed switch position is represented in FIG. 9. If the pawl 25 (see FIG. 8) is raised or actuated, the force generated by the spring 77 acts on the tube or tubular member 60 through the annular flange 76 and the cylindrical skirt 75. The force generated by the actuating or cut-off spring 20, which is disposed parallel to the compression spring 77, also acts on the tubular member 60 through the spring seating member or plate 19, the tubular column or support 62, the annular piston 63 and the ring stop 81. The tubular member 60 moves downward with the same orientation and speed of motion as the spring seating member or plate 19. Hydraulic fluid from the interior of the tubular core 68 can flow into the increasing volume of the space between the center portion of the spring seating member 19 and the annular piston 63. Hydraulic fluid flows through the aperture 74 and through the orifices 71 (not yet closed by the sliding sleeve 72) into the interior of the tubular core 68. It will be understood that the upper or free surface 83 of the hydraulic fluid descends in relation to the tubular core or element 68.

The downward motion induced by the two springs 20 and 77 continues until shortly before the position shown in FIG. 10 is reached. Then the annular piston 63 engages the lower end of the sliding sleeve 72 and slides the latter against the stop on the annular flange 69. Now the orifices 71 are closed and the spring seating member or plate 19 cannot move further downward. Now only the compression spring 77 is effective. It tends to urge, through the cylindrical skirt 75, the tube or tubular member 60 further downward. In other words, the force acting on the tubular member 60 experiences a sudden reduction. The check valve 79 opens and permits hydraulic fluid to be displaced from the diminishing space between the annular flange 78 and the spring seating member 19 and between the tubular column 62 and the tubular member 66 into the increasing space between the annular piston 63 and the annular flange 78 thereby permitting the further downward motion of the tubular member 60. This downward motion of the tubular member 60 and with it the actuating rod 15 under the influence of only the single compression spring 77 continues until the stop ring 81 engages the annular piston 63 which is restrained against further motion by the annular ring flange 69. Therefore, in the switch opening or cut-off stroke this embodiment provides a sudden reduction of the force acting on the actuating rod 15 after somewhat more than half of the travel of the switch opening stroke.

It will be seen from the position shown in FIG. 11 that the actuating force in the switch closing or cut-on stroke acts in an upward direction on the tube or tubular member 60. The check valve 79 is closed. Therefore, the space between the annular piston 63 and the annular flange 78 is closed except for the orifice 65. Therefore, in the switch closing or cut-on stroke the upwardly moving tube or tubular member 60 not only takes the cylindrical skirt 75 with it but also the annular piston 63 and with it the spring seating member or plate 19. The space between the annular piston 63 and the annular flange 78 communicates with the increasing space between the annular piston 63 and the annular flange 69 by means of the orifice 65. The orifices 71 remain closed. A relative motion takes place between the tubular member 60 and the spring seating member 19, since the annular piston 63 is not raised as quickly as the annular flange 78. This is due to a portion of the hydraulic fluid flowing out of the space between the annular piston 63 and the annular flange 78 through the aperture 65 into the space between the annular piston 63 and the annular flange 69. This gives rise to a reduction in the rate of relative displacement between the tube or tubular member 60 and the spring seating member 19. This corresponds to a flatter characteristic curve of the force applied by the switch closing mechanism as will be explained in reference to FIG. 12. As soon as the annular or ring-shaped piston 63 encounters the upper end of the sliding sleeve 72, i.e., towards the end of the switch closing stroke, it pushes the latter upwardly, thereby opening the orifices 71. This permits the pressure in the spaces between the annular piston 63, on the one hand, and the annular flanges 78 and 69, on the other hand, to suddenly diminish. The actuating spring 20 is now loaded and only the compression spring 77 need be further compressed until the annular piston engages the ring stop 80. The position of FIG. 9 is then again reached.

Figure 12:
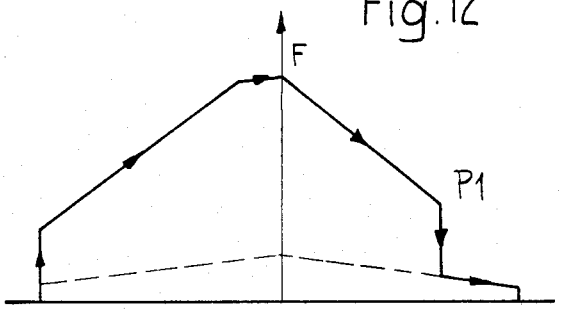
FIG. 12 is a force-displacement diagram for the force transmission device of the switch according to FIG. 8.

The variation in force in a switch opening or cut-off stroke and a switch closing or cut-on stroke is shown in FIG. 12. To the right of the ordinate axis F, the force generated by the actuating or cut-off spring 20 and the compression spring 77 and acting on the tube or tubular member 60 and the actuating rod 15 is represented in relation to the displacement of the switch opening or cut-off stroke. The steep drop of this force at point P1 occurs at the position shown in FIG. 10. To the left of the ordinate axis F in FIG. 12, the variation in the force required of the switch closing mechanism during a switch closing or cut-on stroke is shown. The relative flatness of the curve representing the force variation during the compression of the actuating spring 20 and the still flatter increase of this force as soon as the actuating spring has been compressed, is clearly visible.

While there are shown and described present preferred embodiments of the invention, it is to be distinctly understood that the invention is not limited thereto, but may be otherwise variously embodied and practiced within the scope of the following claims. Accordingly,

What we claim is:

1. An actuating device for a high-voltage switch, comprising:

an actuating rod movable through two strokes of mutually opposite direction for actuating the high-voltage switch to perform a cut-off stroke and a cut-on stroke;

at least one cut-off spring operatively coupled with said actuating rod;

said at least one cut-off spring being loaded and exerting a force on said actuating rod when said cut-on stroke has been performed;

means for variably altering, during said cut-off stroke and said cut-on stroke the force exerted by said cut-off spring upon said actuating rod;

said variably altering means comprising a force transmission mechanism arranged between said cut-off spring and said actuating rod;

said force transmission mechanism possessing a first force-displacement characteristic when said cut-on stroke is performed and a second force-displacement characteristic when said cut-off stroke is performed;

said first force-displacement characteristic differing from said second force-displacement characteristic; and said second force-displacement characteristic comprising a sudden reduction of the force acting upon said actuating rod during said cut-off stroke.

2. The actuating device as defined in claim 1, wherein:

said force transmission mechanism is structured to transmit an initially moderate, and later greater, and finally a low force to said actuating rod during a cut-off stroke.

3. The actuating device as defined in claim 1, wherein:

the force transmission mechanism comprises hydraulic dashpot-like damping means active during a switching stroke.

4. The actuating device as defined in claim 3, wherein:

said dashpot-like damping means comprises: stepped cylinder means;

stepped piston means operatively connected with said actuating rod;

said stepped piston means being displaceable within said stepped cylinder means;

said stepped piston means being structured to define a cylinder in which there is displaceable a piston;

a drive rod at which there is directly effective said cut-off spring; and said piston being connected to said drive rod.

5. The actuating device as defined in claim 4, wherein:

said cylinder is provided with at least one radial aperture;

said stepped cylinder means being provided with step means; and said radial aperture being freed by said step means of said stepped cylinder means during the course of a cut-off stroke.

6. The actuating device as defined in claim 4, wherein:

said stepped piston means comprises a piston end member possessing a relatively large diameter; and a compression spring operativey arranged between said piston connected to said drive rod and said piston end member possessing said relatively large diameter.

7. The actuating device as defined in claim 4, further including:

a braking piston secured to said drive rod;

a braking ring mounted at one end of said stepped cylinder means; and said braking piston cooperating with said braking ring.

8. The actuating device as defined in claim 4, further including:

housing means surrounding said stepped cylinder means while leaving free therebetween a jacket space.

9. The actuating device as defined in claim 3, wherein:

said dashpot-like damping means comprises: cylinder means containing hydraulic fluid and anchored to the actuating rod;

a piston slidably mounted within said cylinder means;

said cut-off spring having a movable end;

said piston being conjointly movable with said movable end of said cut-off spring; and means controlled by said piston in order to prevent at the start of a cut-on stroke or a cut-off stroke the inflow or the outflow of hydraulic fluid to one side of the piston.

* * * * *